United States Patent [19]

Bodine

[11] 4,403,665

[45] Sep. 13, 1983

[54] SONIC SYSTEM FOR PROPELLING PILINGS, DRILLS AND THE LIKE INTO THE EARTH EMPLOYING SCREW DEVICE

[76] Inventor: Albert G. Bodine, 7877 Woodley Ave., Van Nuys, Calif. 91406

[21] Appl. No.: 262,650

[22] Filed: May 11, 1981

Related U.S. Application Data

[63] Continuation-in-part of Ser. No. 76,194, Sep. 17, 1979, Pat. No. 4,266,619, which is a continuation-in-part of Ser. No. 64,046, Aug. 6, 1979, Pat. No. 4,261,425, and a continuation-in-part of Ser. No. 63,840, Aug. 6, 1979, Pat. No. 4,271,915.

[51] Int. Cl.[3] ..... E21B 7/24

[52] U.S. Cl. ..... 175/55; 175/394

[58] Field of Search ..... 175/55, 56, 394; 173/49; 405/232

[56] References Cited

U.S. PATENT DOCUMENTS

| | | | |
|---|---|---|---|
| 3,096,833 | 7/1963 | Bodine | 175/56 |
| 3,499,293 | 3/1970 | Kane | 173/49 |
| 3,865,501 | 2/1975 | Kniep | 175/56 |
| 4,073,353 | 2/1978 | Bodine | 175/56 |

FOREIGN PATENT DOCUMENTS

| | | | |
|---|---|---|---|
| 594245 | 2/1978 | U.S.S.R. | 405/232 |

*Primary Examiner*—William F. Pate, III

*Attorney, Agent, or Firm*—Edward A. Sokolski

[57] ABSTRACT

An eccentric mass rotor is employed to drive a column which may comprise a casing, piling, drill stem or the like into the earth. The rotation axis of this rotor is oriented such that when it is rotatably driven, a rotating force vector component is generated which lies in a plane substantially normal to the longitudinal axis of the bore hole. The rotating force vector causes a portion of the column formed by the drill stem, casing, piling or the like to precess or roll around the wall of the bore hole in a cycloidal manner in forceful engagement with the bore hole wall. Sloping ridges or spiral flanges are formed on a portion of the outer surface of the column, such that the rotary torque generated therein causes forceful engagement of these ridges or spiral flanges with the bore hole wall to thereby effect a screw action which operates to more effectively drive the column down into the earth or with reversal of the direction of torque to pull the column out of the earth.

11 Claims, 7 Drawing Figures

SONIC SYSTEM FOR PROPELLING PILINGS, DRILLS AND THE LIKE INTO THE EARTH EMPLOYING SCREW DEVICE

This application is a continuation-in-part of my application Ser. No. 76,194, filed Sept. 17, 1979, now U.S. Pat. No. 4,266,619 which, in turn is a continuation-in-part of my patent application Ser. Nos. 64,046, now U.S. Pat. No. 4,261,425 and 63,840, now U.S. Pat. No. 4,271,915 both filed Aug. 6, 1979.

This invention relates to the propelling of columns employed in casings, pilings, drills and the like into the earth, and more particularly to a system employing sonic energy which cycloidally drives the column, such column having sloping ridges or spiral flanges thereon for aiding such propulsion.

In my application Ser. No. 76,194 for a "Down-Hole Cycloidal Drill Drive", of which the present application is a continuation-in-part, a driving system for a drill for use in drilling in bore hole in an earthen formation is described. In this device, an orbiting mass oscillator is employed which uses an eccentric mass rotor mounted in a drill stem spaced between the opposite ends thereof. The rotation axis of the rotor of the oscillator is oriented substantially parallel to the longitudinal axis of the stem such that when it is rotatably driven, a rotating force vector component is generated; this force vector lying in a plane substantially normal to the longitudinal axis of the bore hole. This rotating force vector causes a portion of the drill and the stem assembly to precess or roll around the wall of the bore hole in a cycloidal manner and in forceful engagement with the bore hole wall, to thereby effect forceful rotation of the drill stem about its own axis either to directly effect drilling action or aid drilling which is principally achieved by some other drive means which is coupled to the drill stem. In implementing this prior invention, heavy down-weight is required on the drill string to effect forceful engagement of the drill bit with the bore hole. To develop the necessary down-weight ofter requires the use of extra massive drill collars. The use of such extra weight can cause buckling and may result in hole deviation and other attendant problems.

The present invention overcomes such problems by obviating the need for such down-weight by employing spiral flanges or sloping ridges on the walls of the column which engage the bore hole side walls, and by virtue of the forceful screw action thus engendered the column is driven downwardly to provide the needed additional component of longitudinal downward force without resorting to the weighting of the column.

The device of the present invention is useful in the installation of pilings, posts, earth anchors and the like, as well as in coring and drilling. Certain embodiments of the invention employ spiral flutes or flanges on the sides of the column, while other embodiments employ these flutes near the bottom of the column for use in pile driving in lieu of a drill bit. Still further, the device of the invention may be employed to install a jacket pile having a spiral configuration. This invention is based on the discovery that the use of a spiral flange or flute which runs around the outer surface of the column can be effectively employed in a device such as described in my copending application Ser. No. 76,194 in which a rotary force vector is engendered in an earth-insertion member to provide a strong longitudinal bias force between the spiral members and the earthen medium whereby the column is literally pulled into the earth or, in reverse, pulled out therefrom (with reversal of the direction of torque).

It is therefore an object of this invention to provide an improved system for propelling columns into the earth employing a cycloidal rotary driving force on the column in combination with spiral flanges or flutes which engage the bore hole walls to provide a longitudinal bias force with such engagement.

It is another object of this invention to eliminate the need for heavy weight to provide downward bias in a cycloidally driven column.

Other objects of the invention will become apparent as the description proceeds in connection with the accompanying drawings of which:

Figure 1:
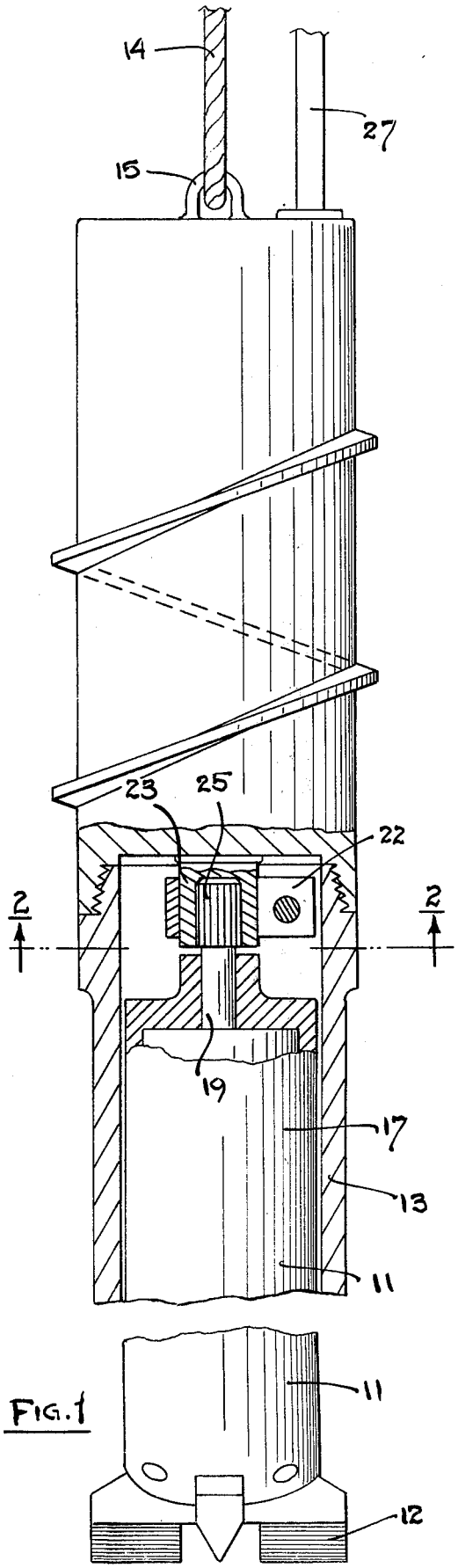
FIG. 1 is a side elevational view partially in cross section of a first embodiment of the invention.
Figure 2:
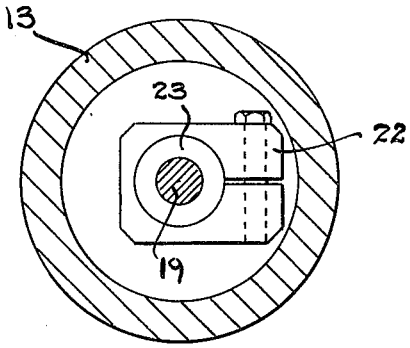
FIG. 2 is a cross-sectional view taken along the plane indicated by 2—2 in FIG. 1.
Figure 3:
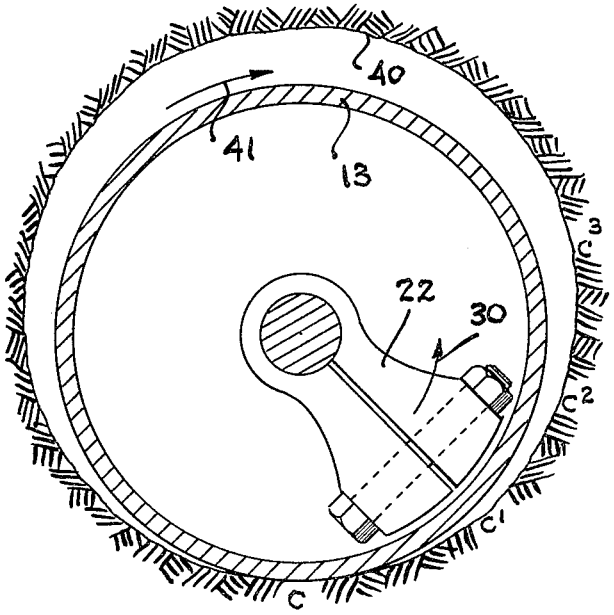
FIG. 3 is a cross-sectional view illustrating the operation of the first embodiment.

This first embodiment is similar to the embodiment of FIGS. 1–3 of my aforementioned patent application Ser. No. 76,194 and differs therefrom only in the addition of spiral flutes 16 which are welded to the side of motor casing 18. This embodiment includes drill stem 11 which is partially contained within jacket 13 and which has a drill bit 12 on the lower end thereof. The device is suspended from above by means of a cable 14 attached to eye 15 which in turn is fixedly attached to the casing 18 of the motor. An oscillator 17, which is also contained within jacket 13 and mounted on stem 11, is rotatably driven by the motor in casing 18 through shaft 19 to generate vibratory energy to drill stem 11 which is transferred to bit 12. The structure thus far alluded to is fully described in my U.S. Pat. No. 3,096,833, which is incorporated herein by reference.

Unbalanced rotor member 22 is clamped to drive shaft 23 of the motor. The motor drive shaft 23 is also coupled to the drive shaft 19 of vibration generating oscillator 17 by means of splined coupling 25 to permit longitudinal vibration of oscillator 17. When the motor receives electrical power from cable 27, it simultaneously rotatably drives both unbalanced rotor member 22 and the rotor of vibratory frequency oscillator 17. The vibratory oscillator 17 causes the oscillatory vibration of stem 11 as described in my U.S. Pat. No. 3,096,833, while the rotation of unbalanced weight 22 generates a rotating force vector in the drill assembly, this force vector lying in a plane which is substantially normal to the longitudinal axis of stem 11.

Referring now to FIG. 3, the effects of this rotating force vector of weight 22 are schematically illustrated. Arrow 30 indicates the rotation of the unbalanced weight 22 which forms a rotor which orbits around in jacket 13. The rotation of rotor 22 generates a rotating radial force which in turn causes a precession or rolling action of jacket 13 around the wall 40 of the drill bore hole in the direction indicated by arrow 41. This results in forceful engagement of successive portions of the jacket or column wall 13 against the bore hole wall 40, as indicated by successive contact points C–C3. The jacket or column thus precesses or rolls with high torque traction around against the bore hole wall, this rolling motion of the jacket being carried down to the drill bit 12 in the form of forceful rotation, which is indicated by arrow 41, to primarily effect the bit's forceful rotating engagement with the bottom bore hole surface being cut. Jacket or column 13 thus may precess with a conical motion, with bit 12 simply rotating as a pivot at the apex of the conical motion. It is to be noted that the high torque rolling motion indicated by arrow 41 is at a low speed which is much lower than the relatively high speed of rotation of the rotor 22, as indicated by arrow 30. This rolling motion force vector causes the flutes or spiral flanges 16 to forcefully engage the side walls 40 of the drill hole bore to effect a downward propulsive screw force, as indicated by arrow 41*a*, on column 13 and drill stem 11, this bias force being effectively applied in driving bit 12 downwardly. This provides the required downward bias without the need for heavily weighting the drill stem. The above described rolling motion progresses the spiral flutes without needing longitudinal vibration therefor, as shown in U.S. Pat. No. 3,504,756.

Figure 4:
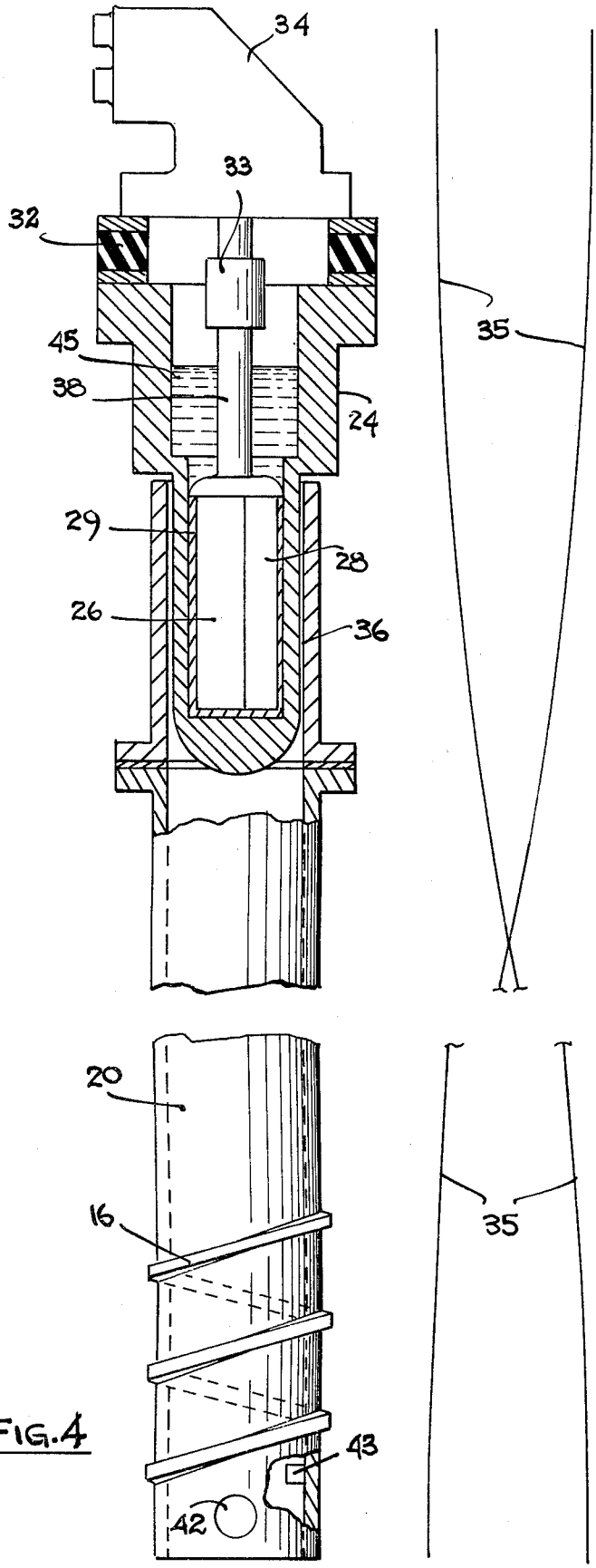
FIG. 4 is an elevational view of a second embodiment of the invention.

Referring now to FIG. 4, a second embodiment of the invention is illustrated, this embodiment being incorporated into a device for driving a pile member 20 into the ground. In this embodiment, the pile column 20 is snugly embraced by the surrounding earthen material rather than having a loose fit in an oversized bore formed by a drill bit (as in the previous embodiment). In this embodiment, an orbiting mass oscillator assembly 24 is formed by rotor portions 26 and 28, with rotor portion 28 being eccentrically weighted so as to form an eccentric mass rotor. Rotor portions 26 and 28 are mounted within shell 29 which is fixedly attached thereto. The shell and rotor members are rotatably driven by means of an adjustable speed hydraulic motor 34 which is supported on oscillator housing 24 on vibration isolation rubber mounts 32. The drive shaft of motor 34 is coupled to the rotor members in the shell through flexible coupler 33 and shaft 38. Spiral flutes or flanges 16 are fixedly attached to the lower portion of column 20 by welding thereto. Plowing ridges 43 are provided along the inner wall of the column to help in breaking up any hard or compacted core material. Further, a vent hole 42 is provided near the bottom end of the column. A lubricating fluid 45 is provided for lubricating the oscillator sleeve bearings which are formed between bearing shell 36 and oscillator shell 29.

Typically, the device is operated by adjusting the speed of motor 34 until the oscillator rotor reaches the quadrature (whirling lateral) resonant frequency of column 20, as indicated by elastic wave pattern 35. Oscillator assembly 24 engages column 20 with a loose-turning fit so that the column can process and rotate without turning the oscillator casing and the motor 34 attached thereto which could cause undesirable twisting of the hoses used to feed power to motor 34. The rotating cycloidal force vector generated by the oscillator causes column 20 to precess, resulting in a high power cycloidal rotation of the column which causes the spiral flutes 16 to drive into the bore hole walls, thereby causing the column 20 to be screw-driven into the ground.

The amplitude of elastic wave pattern 35 automatically adjusts to the hardness of the surrounding earthen material and thus is not limited to a fixed lateral displacement and grip as, for example, the mechanical, fixedly bent screw bar in U.S. Pat. No. 3,049,185. (FIG. 16).

Figure 5:
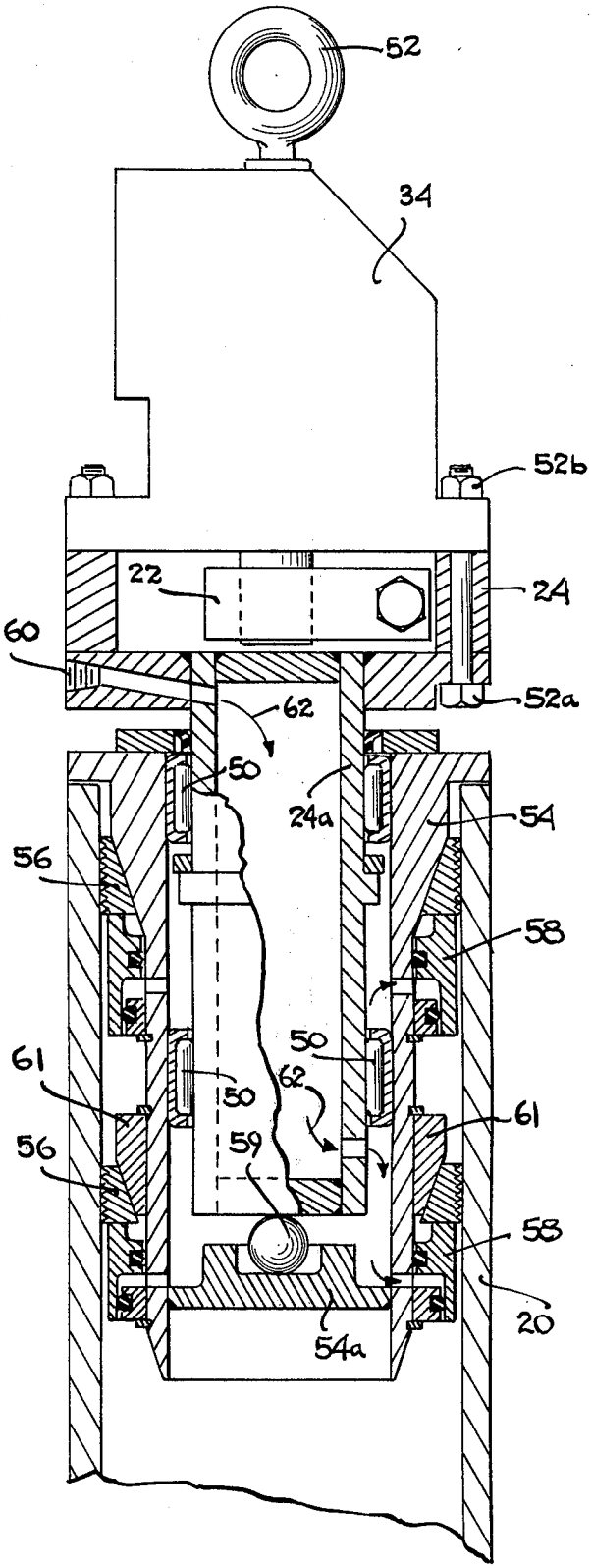
FIG. 5 is an elevational view of an alternate configuration for the oscillator assembly of the second embodiment.

Referring now to FIG. 5, an oscillator assembly which may be used in place of that illustrated in FIG. 4 for the embodiment of FIG. 4 is illustrated. This embodiment is employed for effecting dredging or the like by pumping dirt out from the ground by means of spiral flutes. Motor 34 has an eye hook 52 attached to the top thereof which can be connected to a derrick for exerting upward pulling force on the device. The oscillator assembly 24 of this embodiment employs an eccentric weight rotor 22 of the type utilized in the embodiment of FIGS. 1–3. Hydraulic motor 34 is mounted on the housing of the oscillator and bolted thereto by means of bolts 52*a* and nuts 52*b*. The oscillator housing 24 has a lower portion 24*a* which extends downwardly below rotor 22, this housing portion being supported on a roller ball bearing 59 which is supported in a cup 52*a* formed in housing 54. Needle and thrust bearings 50 are also provided along the sides of housing portion 24*a* to retain such housing portion in position.

The exertion of upward pulling force on eye 52 is transmitted to housing portion 24*a* and thence through bearings 50 to housing 54. Annular wedge jaws 56 are actuated by means of annular hydraulic pistons 58 which drive these jaws upwardly against the sloped surfaces formed thereopposite on the housing (or in the case of the lower jaws, on clamping ring 61 which abuts against the housing). Jaws 58 are driven upwardly by hydraulic pressure supplied thereto as indicated by arrows 62, the hydraulic fluid being fed to the interior of housing portion 24*a* through fitting 60.

In accomplishing a dredging operation, the column 20 is first driven into the ground as described in connection with the embodiment of FIG. 4. Then, the direction of rotation of motor 34 is continued to produce a corresponding continuation in the direction of rotation for oscillator rotor 22 while support ring 52 is held against further downward travel. This causes a stopping of the downward progress of column 20, causing the spiral flutes 16 to instead pump dirt up with the same relative motion along side of the column while hauling up on the column by means of the derrick attached to hook 52. During such upward hauling, the hydraulic pistons 58 are all actuated to assure that the oscillator assembly and the motor which is attached thereto are held in tight clamping engagement with column 20.

It is to be noted that the direction of the hydraulic motor can be reversed in any of the species of the invention to effect reversal in the rotation of the oscillator rotor so as to cause the spiral flutes to propel the column up out of the ground if extraction thereof is desired.

Figure 6:
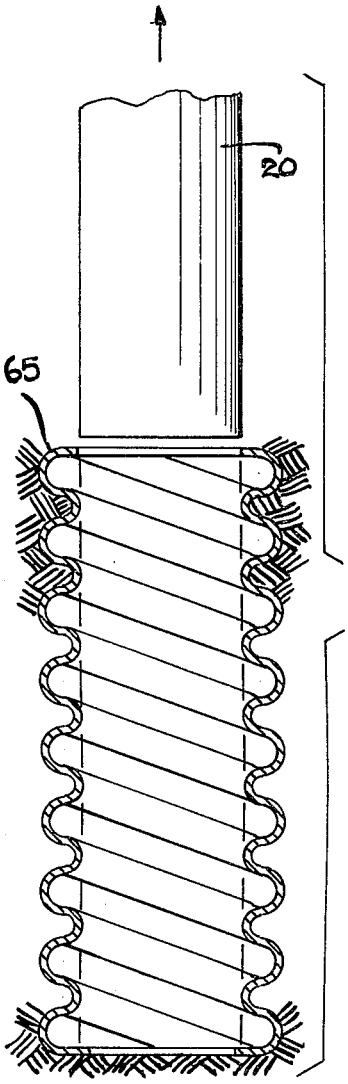
FIG. 6 is an elevational view illustrating the use of the invention for installing a jacket piling.

Referring now to FIG. 6, a further use of the embodiment of FIG. 4 is illustrated, in this instance, the column member 20 being employed as a mandrel which is inserted within corrugated jacket pile 65, the corrugations in the jacket forming a spiral "flute". The bottom end of jacket 65 may be either open-ended or closed as may be desired. With the rolling precession of column 20 in response to the described action of the oscillator of FIG. 4, the spiral jacket 65 is effectively "screwed" into the ground and tightly installed therein. The mandrel provided by column 20 then can be removed.

Figure 7:
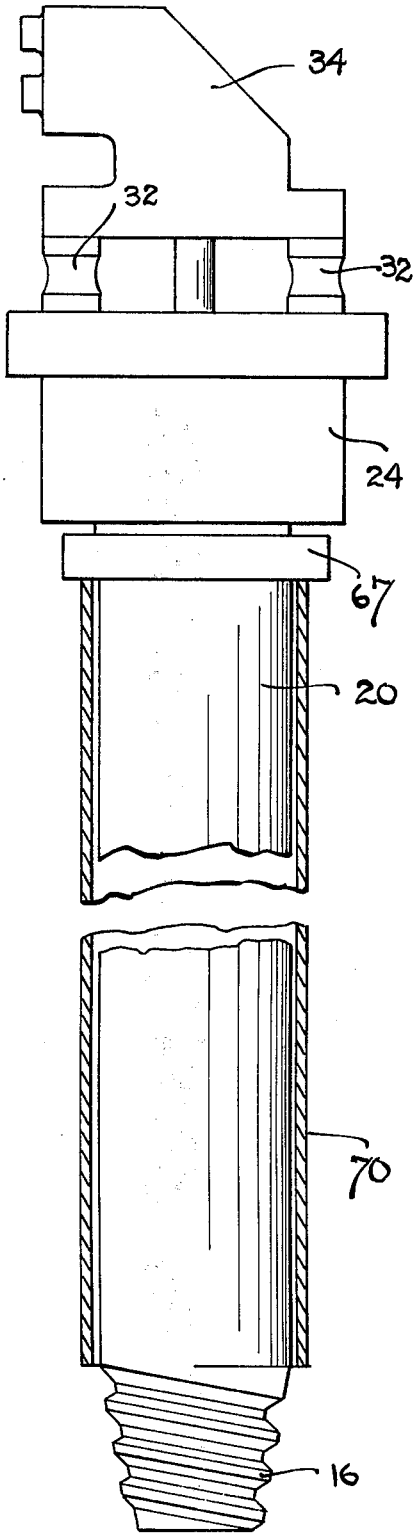
FIG. 7 is an elevational view of a third embodiment of the invention useful for installing a jacket in the ground.

Referring now to FIG. 7, a still further embodiment of the invention is illustrated. This embodiment employs a motor 34 like that of the embodiment of FIG. 4 which is mounted on oscillator housing 24 by means of vibration isolators 32. The oscillator assembly 24 may be of the type shown in FIG. 4. Column 20 has spiral screw flutes 16 on the bottom end thereof and thus with the precessing action of the column, as described in connection with FIG. 4, the flutes 16 drive down into the ground. A jacket 70 to be installed is placed beneath shoulder 67 which is fixedly attached to the top end of column 20. Thus, as spiral flutes 16 drive into the ground with the precessive action, shoulder 67 which engages jacket 70 forces this jacket into the ground in an installed position. Once the jacket is installed, column 20 can be withdrawn.

The system of the present invention thus provides a highly effective means for either driving columns, casings, drills, pilings, etc. into the ground or removing such objects from the ground. Further, the system of the present invention can be used for excavating earthen material.

While the invention has been described and illustrated in detail, it is to be clearly understood that this is intended by way of illustration and example only and is not to be taken by way of limitation, the spirit and scope of the invention being limited only by the terms of the following claims.

I claim:

1. A system for cycloidally driving a column through earthen material, said column being activated in a bore hole formed in said earthen material, comprising a spiral flute formed in at least a portion of the outer surface of said column, said flute being in firm engagement with the earthen material surrounding said bore hole, a rotor having an eccentric mass, means for rotatably supporting said rotor on said column with the axis of rotation of the rotor being substantially parallel to the longitudinal axis of the column, and means for rotatably driving the rotor to generate a force vector in said column which is generally transverse of the longitudinal axis thereof and which rotates about an axis substantially parallel to the longitudinal axis of the column to cause cycloidal vibration of the column, the fluted portion of said column precessing with a cycloidal motion around the side wall of the bore hole in forceful driving engagement thereagainst.

2. The system of claim 1 and further comprising a drill stem coupled to said column and a drill bit at the end of said stem in driving engagement with the bottom of said bore hole, said spiral flutes being on an upper portion of the column.

3. The system of claim 1 wherein said column is a casing to be installed in the ground, said spiral flutes being on a portion of said casing near the bottom thereof.

4. The system of claim 1 wherein said spiral flute comprises a corrugated jacket member, said column being inserted in said jacket member in driving engagement therewith but removable therefrom on the application of lifting force to said column.

5. The system of claim 1 wherein said flutes are formed on the bottom end of said column, a shoulder member near the top end of said column, and a jacket to be driven into the ground being placed between said shoulder and said flutes in said bore hole, said jacket member being driven into the ground by said shoulder member with the flutes spirally driving through the bottom of the bore hole.

6. The system of claim 1 wherein said rotor is supported within said column.

7. The system of claim 1 wherein said rotor is supported on said column, thereabove.

8. The system of claim 1 and further including clamping means for selectively tightly clamping said rotor, the means for supporting said rotor and the means for driving said rotor to said column, and means for pulling all of the last-mentioned means upwardly so as to pump earthen material out of said bore hole.

9. In combination, a piling member having spiral flutes on the outer surface thereof and a drive system for cycloidally driving said piling in tight engagement with earthen material forming a bore hole, said drive system including an eccentric mass rotor, means for rotatably supporting said rotor on said piling towards one end thereof, the other end of said piling being at the bottom of said bore hole, the rotation axis of said rotor being substantially parallel to the longitudinal axis of said piling, and means for rotatably driving said rotor to generate a rotating force vector in a plane generally transverse of the longitudinal axis of the piling, said force vector rotating about an axis substantially parallel to the longitudinal axis of the piling so as to cause cycloidal vibration of the piling, said force vector acting on said one end of said piling to cause said piling to precess cycloidally around the side wall of the bore hole with the flute rotatably engaging the wall of the bore hole.

10. The system of claim 9 wherein said piling comprises a corrugated jacket member and further including a column member inserted within said piling, the rotor being mounted in said column.

11. The system of claim 9 wherein the flute is located on the other end of said piling which is located near the bottom of said bore hole.

* * * * *